United States Patent [19]

Hartmann et al.

[11] 4,257,246

[45] Mar. 24, 1981

[54] ARRANGEMENT FOR THE CONTINUOUS TREATMENT, PARTICULARLY WASHING, OF TEXTILE MATERIALS

[75] Inventors: Werner Hartmann, Krefeld; Johannes Kutz, Tönisvorst; Dieter Itgenshorst, Krefeld, all of Fed. Rep. of Germany

[73] Assignee: Eduard Küsters, Krefeld, Fed. Rep. of Germany

[21] Appl. No.: 62,303

[22] Filed: Jul. 31, 1979

[30] Foreign Application Priority Data

Aug. 9, 1978 [DE] Fed. Rep. of Germany ..... 2834854

[51] Int. Cl.[3] ..... D06B 5/08

[52] U.S. Cl. ..... 68/200; 68/208

[58] Field of Search ..... 68/43, 62, 181 R, 202, 68/205 R, 208, 200; 134/83, 122 R, 122 P

[56] References Cited

U.S. PATENT DOCUMENTS

| | | | |
|---|---|---|---|
| 1,626,439 | 4/1927 | Voegeli | 68/43 |
| 2,993,470 | 7/1961 | Stickel | 134/122 R X |
| 3,470,571 | 10/1969 | Hrboticky | 68/205 R X |
| 4,092,839 | 6/1978 | Bahre et al. | 68/181 R X |
| 4,095,442 | 6/1978 | Brugman | 68/205 R X |

*Primary Examiner*—Philip R. Coe

*Attorney, Agent, or Firm*—Kenyon & Kenyon

[57] ABSTRACT

In an arrangement for the continuous treatment, especially washing, of spread out liquid permeable textile material in web form, several deflection cylinders, over which the material is conducted and at which liquid on the side of the textile material facing the deflection cylinders is pushed through the textile material, are provided in pairs close together but not touching each other, with the textile material in web form passing immediately from one deflection cylinder of the pair to the other. The deflection cylinder of each pair following the other in the web travel direction is being arranged lower than the preceding deflection cylinder of the pair, so that the textile material runs substantially vertically over a short section when passing from the preceding to the following deflection cylinder of each pair.

9 Claims, 6 Drawing Figures

ARRANGEMENT FOR THE CONTINUOUS TREATMENT, PARTICULARLY WASHING, OF TEXTILE MATERIALS

BACKGROUND OF THE INVENTION

This invention relates to the treatment of liquid permeable textile material in web form in general and more particularly to an improvement arrangement for the treatment, particularly a washing treatment, of textile material in web form.

Apparatus for the continuous treatment, particularly for washing liquid permeable textile material in web form, which is spread out, the apparatus including a plurality of deflection cylinders over which the material is conducted and at which cylinders, liquid on the side of the textile material facing the deflection cylinders is pushed through the textile material is described in German Auslegeschrift No. 14 60 454. In the design disclosed therein the deflection cylinders are arranged one over the other in two rows with a horizontal spacing from each other. The deflection cylinders are offset in height with respect to each other.

The textile material in web form is conducted back and forth in zig-zag fashion between deflection cylinders and thus forms horizontal loops. Due to the liquid on the surface of the textile material, the latter can sag downward under the weight of the liquid, which can impair the proper running of the material and bring with it the danger of the formation of folds.

SUMMARY OF THE INVENTION

It is an object of the present invention to design an arrangement of the type mentioned above in such a way that the web of the textile material is not loaded by the weight of the liquid which is to be pushed through at the next deflection cylinder so heavily that problems with the running of the material can arise. This object is accomplished by providing the deflection cylinders in pairs which are close together but do not touch each other and causing the textile material in web form to pass immediately from one deflection cylinder to the other deflection cylinder of the pair.

Due to this arrangement of the deflection cylinders and the web, the textile material in web form runs freely only over a short distance between the two deflection cylinders of a pair. Between these substantially vertically descending web sections and the circumference of the respective lower deflection cylinders of a pair, an upright corner, so to speak, is formed, in which the weight of the liquid standing there is essentially supported by the deflection cylinder but not by the textile material in web form which extends vertically in this region. Due to this circumstance and the very compact web arrangement, it is possible to operate with considerable speeds and correspondingly with considerable quantities of liquid accumulating and being pushed through in the corner, without the danger of the formation of folds.

Furthermore, the deflection cylinder of each pair which is the following cylinder in the travel direction is disposed lower than the preceding deflection cylinder of the pair and the textile material is caused to run substantially vertically over a short section when passing from a preceding to a following deflection cylinder of each pair.

This insures that the liquid, which has already been used once and is to be used again, gets onto the web at a point from which it is taken along immediately into the zone of pushing through. The liquid therefore has no opportunity to run off unused on the way to the next deflection cylinder.

From DE-AS No. 14 64 454, it is known to collect the liquid which is pushed through and flung off when negotiating the deflection cylinders, and to conduct it to a preceding section of the web running past underneath.

Collecting trays which are arranged under the deflection cylinders are described in DD-PS No. 68 669. In accordance with a further feature of the present invention, collecting trays are provided by means of which the liquid passed through the web can again be applied to the side of the textile material facing a deflection cylinder, these trays applying the liquid into the corner between substantially vertically section of the textile material and the circumference of the following deflection cylinder.

In accordance with a further feature of the present invention, collecting trays of this nature have, at a wall extending in the width direction, an overflow edge which rises at an incline from the center towards the sides. This design of the collecting tray, makes it possible to apply the collected liquid which is to be conducted onto the preceding section of the web to the web with a gradual transition at the edges. Due to the inclined rise of the overflow edge, the overflowing layer of liquid gets thinner and thinner outward, and, therefore, no abrupt transition between the full applied quantity and no quantity at all takes place.

Furthermore, it is most beneficial if the collecting tray is disposed to be tilted about a transverse axis. By simple rotation, the width of application can be changed and thereby adjusted. In this manner the arrangement can be adapted to different widths of material.

By making the overflow edge horizontal in the central region, the amount of application in the central region of the web of the material is essentially constant. Furthermore, by distributing holes uniformly over the working web in the bottom of the collecting tray, a certain basic amount of the liquid is applied uniformly over the web.

The basic features of the present invention so far discussed can be obtained with a single pair of deflection cylinders. In an actual embodiment of a washing machine a number of pairs of deflection cylinders are naturally used in order to increase the washing effect.

In accordance with a further feature of the present invention where a number of pairs are used, two pairs of deflection cylinders are always arranged on top of each other in a mirror image fashion, symmetrical to a horizontal center plane. This results in a meandered shaped course of the web of the material and the preceding, i.e., the upper deflection cylinder of the lower pair is thus located beneath the following, i.e., the lower, deflection cylinder of the upper pair. These deflection cylinders are therefore closer together. Between these cylinders, the collecting tray can be mounted with its overflow edge located naturally over the upright corner of the lower pair.

Furthermore this meander shaped web arrangement with two pairs of cylinders can be repeated over and over again to form a larger washing machine.

The basic idea of the present invention is to insure, to the greatest extent possible, that none of the water employed runs unused past the web of textile material and at the same time the water is pushed through the textile material, not once, but a number of times in order to achieve maximum utilization of the water.

DETAILED DESCRIPTION OF THE INVENTION

Figure 1:
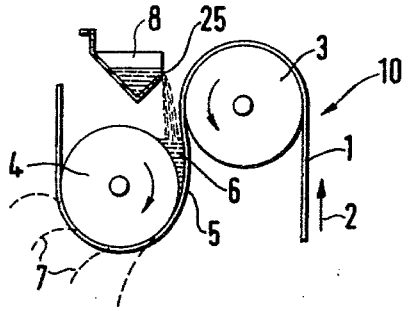
FIG. 1 is a cross section through the pair of deflection cylinders according to the present invention.

In FIG. 1, a liquid permeable textile material in web form which advances in the direction of the arrow 2 and is looped first over one deflection cylinder 3 and then over a deflection cylinder 4 is shown. The deflection cylinders 3 and 4 are closely adjacent but do not touch each other. The deflection cylinder 3 is arranged somewhat higher than the deflection cylinder 4, so that the textile material in web form travels, during its transition from deflection cylinder 3 to deflection cylinder 4, a short distance 5, in which it extends vertically or nearly vertically. In the region in which the section 5 is adjacent to the deflection cylinder 4, one obtains, in this manner, an "upright" corner 6 in which liquid, i.e., generally washing liquor, accumulates. The liquid is taken along the side of the web shaped textile material which is on the side facing the deflection cylinder 4 and is backed up by the contact with the circumference of the deflection cylinder 4 to form a bulge. Part of the liquid standing in the corner 6 is taken along by the rotation of the deflection cylinder 4 in the direction of the arrow between the web shaped textile material 1 and the circumference of the deflection cylinder 4 and is trapped there by a certain amount of hydrostatic pressure brought about by the tension of the web. Under this pressure, the liquid is pushed through the web of permeable textile material and emerges on the outside, as is indicated by the jets 7.

Into the upright corner 6, additional liquid can be fed from a collecting tray 8 which extends over the width of the web and has an overflow edge 25 at which the liquid overflows.

The pair of deflection cylinders 3 and 4 as a whole with the section of the web shaped textile material 1 looped around them in the manner described will be designated as 10.

Figure 2:
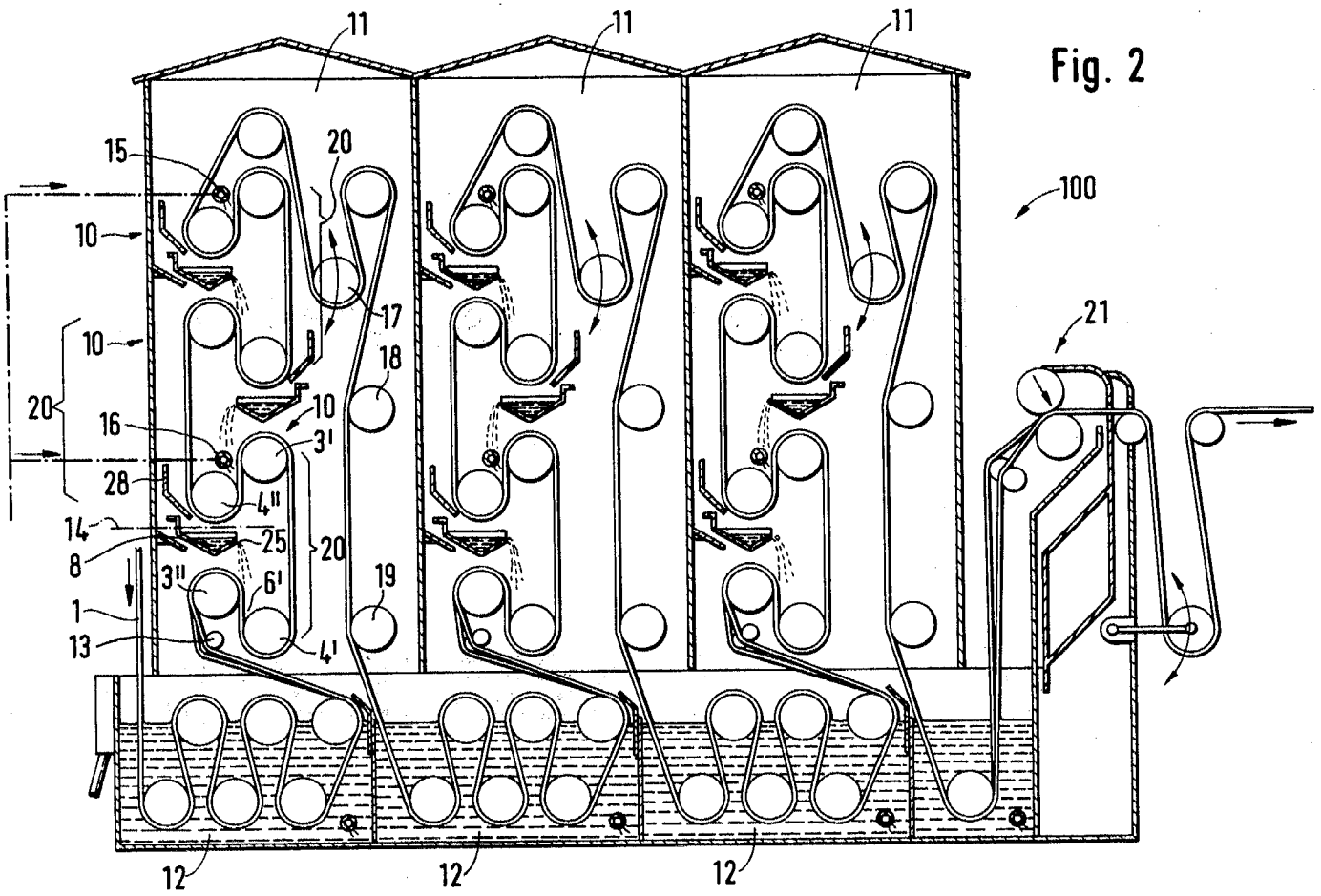
FIG. 2 is a vertical longitudinal cross section through a washing machine in which the present invention is utilized.

In the washing machine 100 of FIG. 2, several such cylinder pairs 10 are connected in series. The washing machine 100 comprises three washing compartments 11, which are identical to each other, are connected in series, and each of which are preceded by a rinsing bath 12 with boiling washing water. Textile material 1 enters the first rinsing bath 12 in the direction of the arrow, where it is then freed of coarse adhering dirt and is heated up. It is then conducted over a spreading cylinder 13 and runs upon the first pair of deflection cylinders 10 which correspond to the pair of deflection cylinders 10 of FIG. 1. Directly above this pair of deflection cylinders 10, a further pair of deflection cylinders 10 is arranged which is situated with mirror symmetry to the center plane 14. The textile material in web form thus runs from the lower deflection cylinder 4' of the lower pair vertically upward to the upper deflection cylinder 3' of the upper pair. The textile material 1, enters on the upper deflection cylinder 3'' of the lower pair 10 and leaves at the lower deflection cylinder 4'' of the upper pair. Entry and exit, therefore, take place at the deflection cylinders 3'' and 4'' which are closest together. One obtains in this manner an approximately meander shaped course of the textile material 1 over the four deflection cylinders 3'', 4', 3' and 4'', in this order.

This meander shaped grouping designated as the whole with 20 is advantageous because below the deflection cylinder pair 10, a collecting tray 8 can be mounted which extends over the working width and the overflow edge 25 of which is located above the upright corner 6' of the lower deflection cylinder 4' of the lower pair 10. The liquid pushed through above the tray 8 is, in this manner, used again at a preceding point.

The meander like grouping 20 is repeated two more times in each washing compartment 11; the last pair of cylinders of each grouping 20 forms, at the same time, the first respective cylinder pair of the next grouping 20. All the corresponding deflection cylinders are located vertically above each other.

Fresh washing liquor is supplied at the uppermost deflection cylinder pair 10 from below through the feed line 15. At the second pair of deflection cylinders 10, further supply can be from below, through the feed line 16.

From the uppermost pair of deflection cylinders 10 of the first washing compartment 11, the web shaped textile material 1 is conducted, via a compensating roller 17 serving for regulating the web tension as well as via guide rollers 18, and 19, serving for preventing the formation of folds, into the rinsing tank 12 of the next washing compartment 11 which otherwise is constructed exactly as the preceding washing compartment 11. After leaving the last washing compartment 11, the web of material is conducted through a squeeze mechanism 21 of known design, where it is freed of excess moisture and is then drawn off for further processing.

The function of the collecting tray 8 will be seen in detail in FIGS. 3–6. The collecting tray 8 is formed by a trough extending over the working width which in the illustrated embodiment has an approximately V-shaped cross section, but which can also be shaped differently, for instance, curved. At the ends, the trough is supported in the machine housing and can be tilted in bearing journals 22 and 23, about a transverse axis. The wall 24 of the trough forms an overflow edge 25 which has a central horizontal portion 26 as well as portions 27 which rise at an angle outward.

Figure 3:
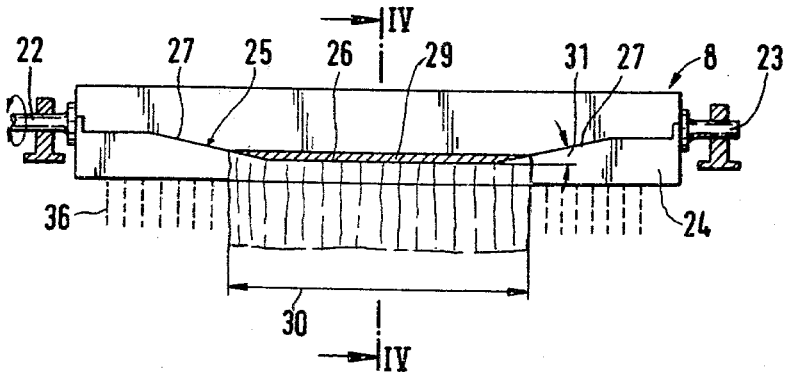
FIG. 3 is a view of a collecting tray in a first position of rotation from the front.
Figure 4:
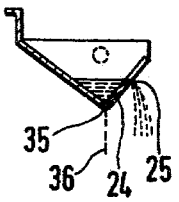
FIG. 4 is a cross section along the line IV—IV in FIG. 3.

This design regulates the width over which the washing liquid overflowing at the overflow edge 25 is given off to the web. In the steady state condition, a substantially constant amount of water is fed to each collecting tray 8; this amount of water is composed, for instance, of the amount of water dropping directly at the deflection cylinder 4'' (FIG. 2), and of the amount of water flung off and collected by the collecting baffle 28 there. Since this amount of water passes the overflow edge practically without pressure, a certain overflow cross section corresponds thereto, which is indicated in FIG. 3 by the hatched zone 29. The cross section 29 has constant height in the central region 26 and is narrowed down toward the outside to zero along the inclines 27.

A running liquid flow is obtained of a width which is indicated by the arrow 30.

Figure 5:
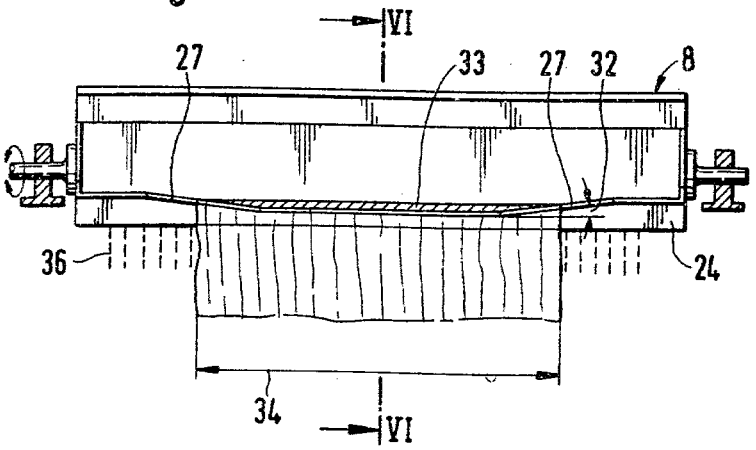
FIG. 5 is a view of the collecting tray according to FIGS. 3 and 4 in another position of rotation.
Figure 6:
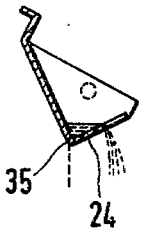
FIG. 6 is a cross section along the line VI—VI in FIG. 5.

In FIGS. 5 and 6, the collecting tray 8 is tilted more. As a result, the inclines 27 appear much shallower in a vertical plane. In FIG. 5, they form only the angle 32 with the horizontal instead of the angle 31 in FIG. 3.

Since the conditions are otherwise to be constant and the flow cross section thus must likewise remain the same, the cross sectional shape 33 takes the place of the cross sectional shape 29 of the flow; the former is somewhat lower but extends further up the inclines 27 instead. A width 34 of the liquid delivery results. The range of widths covered by the liquid delivery can therefore be controlled by the inclination of the collecting tray 8 about the transverse axis, and an adaption to varying web widths and for one and the same web width, to the requirements of the best liquid application can be made.

The collecting tray 8 can also have, at its lowest point, openings 35, which are arranged at uniform spacings over the working width, and let liquid reach the textile material 1 in web form in jets 36, in addition to the liquid overflowing at the overflow edge 25.

What is claimed is:

1. In an arrangement for the continuous treatment, especially washing, of spread out liquid permeable textile material in web form, comprising several deflection cylinders, over which the material is conducted and means for applying liquid to only the side of the textile material facing the deflection cylinders so that the liquid will be pushed through the textile material, the improvement comprising:

the deflection cylinders being provided in pairs close together but not touching each other, the textile material in web form passing immediately from one deflection cylinder of the pair to the other;

the deflection cylinder of each pair following the other in the web travel direction being arranged lower than the preceding deflection cylinder of the pair, with the textile material running substantially vertically over a short section when passing from the preceding to the following deflection cylinder of each pair; and the means for applying liquid being at a location preceding said following cylinder, at said section running substantially vertically and applying liquid to the side of said textile material facing said following deflection cylinder, whereby said liquid will be pushed through the textile material by said following deflection cylinder.

2. The improvement according to claim 1 and further including means for applying liquid which has been pressed through the web again to the side of the textile material facing a deflection cylinder, said means arranged to apply the liquid into the corner between the substantially vertical section of the textile material and the circumference of the following deflection cylinder.

3. The improvement according to claim 1 and further including a collecting tray, by means of which liquid pushed through at a deflection cylinder is collected over the entire width of the textile material in web form, said collecting tray having at a wall extending in the width direction, an overflow edge which rises at an incline from the center toward the sides for conducting liquid collected therein onto a narrowed width range in the center of the web onto a preceding section of the textile material.

4. The improvement according to claim 3 and further including means supporting said collecting tray for rotation about a transverse axis.

5. The improvement according to claim 4 wherein said overflow edge is horizontal in the central region.

6. The improvement according to claim 5 and further including holes, uniformly distributed over the working width, arranged in the bottom of said collecting tray.

7. The improvement according to claim 6 wherein a plurality of pair of deflection cylinders are provided and wherein two pairs of deflection cylinders are always disposed one over the other symmetrically to a horizontal center plane.

8. The improvement according to claim 7 wherein said collecting tray is disposed below the lower cylinder of an upper pair with its overflow edge disposed above the corner between the web shaped textile material and the following deflection cylinder of the lower pair.

9. The improvement according to claim 1 wherein a plurality of pair of deflection cylinders are provided and wherein two pairs of deflection cylinders are always disposed one over the other symmetrically to a horizontal center plane.

* * * * *